US005100010A

United States Patent [19]

Waters

[11] Patent Number: 5,100,010

[45] Date of Patent: Mar. 31, 1992

[54] CONTAINMENT SEAL ASSEMBLY

[75] Inventor: William E. Waters, Pleasanton, Calif.

[73] Assignee: The West Company, Incorporated, Phoenixville, Pa.

[21] Appl. No.: 610,532

[22] Filed: Nov. 8, 1990

[51] Int. Cl.[5] ..... B65D 51/20

[52] U.S. Cl. ..... 215/248; 215/247

[58] Field of Search ..... 215/247, 248, 308

[56] References Cited

U.S. PATENT DOCUMENTS

| | | | |
|---|---|---|---|
| 2,342,215 | 2/1944 | Perelson | 215/247 |
| 2,667,986 | 2/1954 | Perelson | 215/247 X |
| 3,321,098 | 5/1967 | Ogle | 215/247 |
| 3,707,239 | 12/1972 | Harris, Sr. et al. | 215/247 |
| 3,977,555 | 8/1976 | Larson | 215/247 |
| 4,261,474 | 4/1981 | Cohen | 215/250 |
| 4,465,200 | 8/1984 | Percarpio | 215/247 |
| 4,582,207 | 4/1986 | Howard et al. | 215/247 |
| 4,834,149 | 5/1989 | Fournier et al. | 215/248 X |
| 4,869,384 | 9/1989 | Ogle, II | 215/247 |
| 4,920,976 | 5/1990 | Calzi et al. | 215/247 X |

*Primary Examiner*—Stephen Marcus
*Assistant Examiner*—Vanessa Caretto
*Attorney, Agent, or Firm*—Eugene E. Renz, Jr.

[57] ABSTRACT

A cap assembly for use with a container having a stopper and a closure including a cap defining a chamber above a stopper. The cap on said closure, said cap including an access disc penetrable by a syringe position in alignment with the stopper for access to the container by the syringe. The assembly further including vent ports for communication between the chamber and the atmosphere. Finally there is a filter in the chamber for filtering gas flow through the vent port.

9 Claims, 4 Drawing Sheets 10
12
13
14
15
16
17
18
19
20
21
22
23
P

CONTAINMENT SEAL ASSEMBLY

FIELD OF THE INVENTION

This invention relates generally to containers and cap closures therefor. The container can be the type adapted to contain a serum material, in the nature of a serum vial, and a composite cap therefor. The cap design and structure allows for use of a syringe to add or remove liquids from the container.

BACKGROUND OF THE INVENTION

Many pharmaceutical products are supplied in glass vials which have a closure which can be penetrated by a syringe so as to add or subtract material from the container. For example, often times, medicines are supplied in dry form inside a vial having a rubber closure or stopper. Liquid such as deionized water is added to the vial to dissolve or suspend the solid material. Sometimes, serum and other medicines are freeze dried in the vial and ar then reconstituted in the vial.

When an ordinary container and closure is used to dispense medicines which have been reconstituted, several problems are created. Normally when a liquid is added to a powder in a vial there is an increased pressure in the container and syringe due to the change in volume. This pressure tends to force a discharge of the liquid through an opening formed by the closure puncture and the hypodermic needle point, either when the needle is withdrawn or later when a needle is inserted to withdraw some of the contents.

Another difficulty arises when the powders and the newly formed liquids experience aerosoling. This phenomenon occurs when small particles or droplets, either powder or in the liquid state, become airborne during the turbulence caused from the pressure released during withdrawal or insertion of the needle into the container. Thus, these airborne particles escape from the container and may contact the health care worker.

Normally, the above described problems are inconvenient but do not create a major cause for concern. However, advances in modern medicine have made the aerosoling problem and others as described above much more serious. Specifically, during the treatment of cancer, chemotherapy drugs are packaged in glass vials in a freeze dried form and are thereafter reconstituted at the time when treatment is beginning. Various quantities of the reconstituted liquid are withdrawn over a period of time using syringes. Because cancer treating drugs are often times powerful, sometimes causing retardation or stoppage of all cell growth, it is obviously an advantage to avoid having unnecessary contact. Every effort is made to avoid contact by the preparer and dispenser of chemotherapy drugs. Not only cancer treating materials are of concern. As AIDS and AIDS related diseases are treated, drugs which are used may not be safe for universal contact. Antibiotics and cloning drugs also need to be carefully monitored.

Accordingly, it is an object of the this invention to provide a cap assembly for use with a closed container having a closure which captures the immediate atmosphere generated by the addition of fluids to the contents of the vial via a syringe. It would be of great advantage if a device could be designed which would keep chemicals from leaving containers and which would capture and release pressure generated during the use of syringes in association with those containers. Other objects will appear hereinafter.

SUMMARY OF THE INVENTION

It has now been discovered that the above and other objects of the present invention can be accomplished in the following manner. Specifically, a new cap assembly has been discovered which is admirably suited for use with a closed container having a closure. The cap assembly is particularly suitable for use with conventional pharmaceutical vials which are fitted with a rubber stopper as a closure.

The cap assembly includes cap means attached to the container. This cap means contains an upwardly extending cylindrical member containing a cylindrical filter and a containment disc which are positioned to be above the closure upon attachment of the cap and the container. The upwardly extending cylindrical cap, filter and disc cooperatively define a closed flash back chamber. The chamber is additionally provided with vent port means to relieve pressure in the chamber. There is access to the interior of the container with a syringe through the contaminant disc and the stopper forming part of the closure.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figures 1, 2, 3, 4:
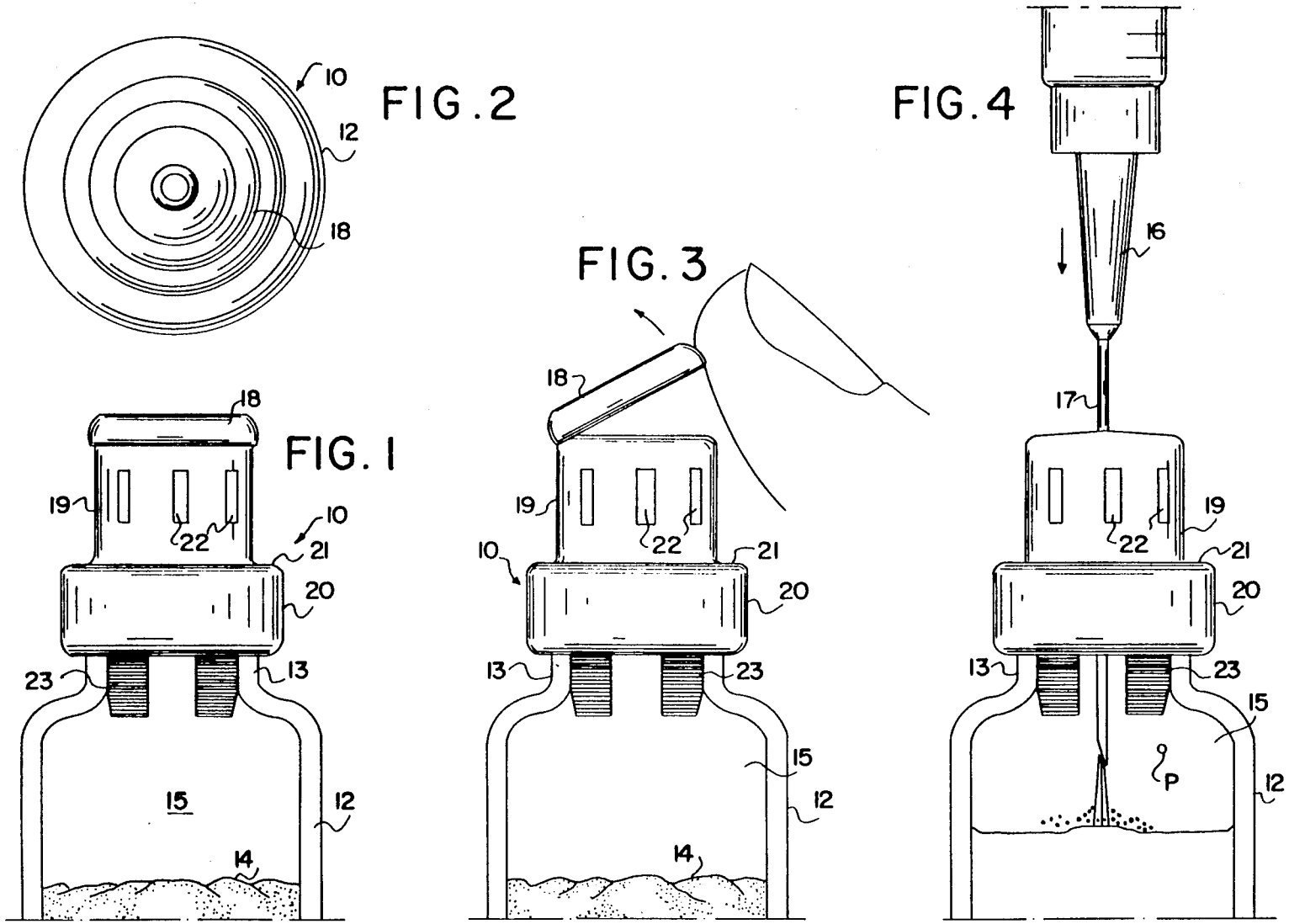
FIG. 1 is a fragmentary side elevational view of a cap assembly device and container in accordance with the present invention.
FIG. 2 is a plan view of the device shown in FIG. 1.
FIG. 3 is a view similar to FIG. 1, with a top cap portion being removed.
FIG. 4 is a view of the device shown in FIG. 3, in combination with a syringe.
Figure 5:
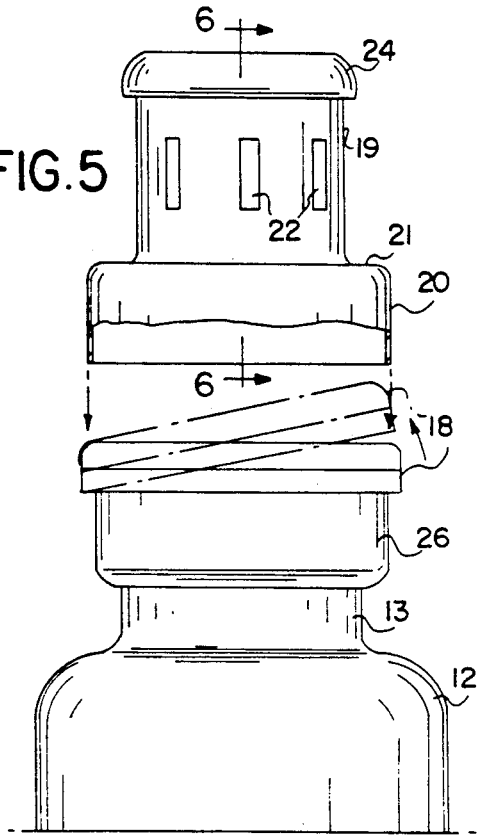
FIG. 5 is a side elevational view showing the application of the invention to a closure on a container.
Figure 6:
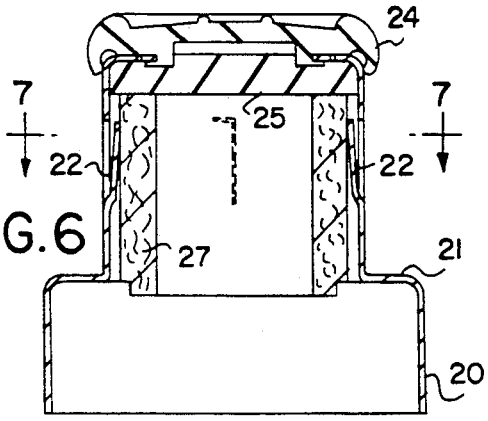
FIG. 6 is an enlarged sectional view taken along the line 6—6 in FIG. 5.
Figure 7:
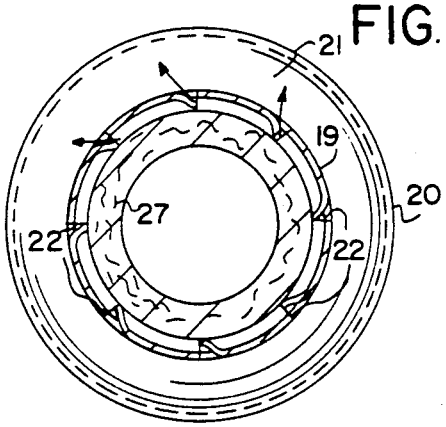
FIG. 7 is an enlarged sectional view taken along the line 7—7 in FIG. 6.

The invention, and the principles thereof, are shown in the drawings and will be described with respect to the incorporation or combination of the invention with a typical glass serum vial. This container, or vial, is shown in combination with a container assembly generally designated as 10 in FIG. 1. The container 12 is constructed in the conventional manner with a vial neck 13. The container 12 contains a serum material 14 which only partly fills the vial 12, leaving an empty space 15 which is normally occupied by air at atmospheric pressure. The container is designed for use with a syringe, such as the syringe 16 shown in FIG. 4, having a needle 17.

As shown in FIG. 3, the device may include a top cap 18 which is removable by finger pressure, breaking seals which give evidence of tampering or prior opening. The removable cap portion 18 is of conventional design, such as that shown in U.S. Pat. No. 3,446,170, assigned to The West Company, Incorporated. The button or top is severed from the top cap at a fracturable bridge connection or controlled score, to thereby expose a stopper or other part of the closure assembly. Any method for attaching a button or top cap may be employed in connection with the present invention, as can other means for protecting the integrity of the container prior to its use.

Once cap 18 has been removed, such as in FIG. 3, the syringe 16 and needle 17 are inserted into the container where a reconstituting liquid such as deionized water may be added to powder 14 to form a useful serum for treatment of a patient. In a normal situation, the addition of liquid to the vial 12 causes an increase in pressure P in the air space 15. When the needle 17 is withdrawn from the vial 12, the increased pressure in the space 15 causes a flashback of some of the liquid through the puncture in the stopper.

When these small droplets or particles in the liquid state become airborne during turbulence caused from insertion of the fluid into the container, the particles are likely to contact the health care worker. If chemotherapy drugs or other serums which are dangerous and need to be isolated from the preparer are not properly contained in the viai 12, this aerosoling effect places the operator at a potential risk of contamination.

Shown in FIG. 4 is one embodiment of the invention, which includes an upwardly extending cylindrical member 19 which extends up from a skirt 20 and shoulder 21 to form the cap assembly which is to be attached to the bottle 12. Vent ports 22 permit the escape of pressure vented into the cap from the interior 15 of the bottle 12 as will be described hereinafter.

In FIGS. 5 through 9, a particular embodiment is designed for use on a bottle 12 after the removable top cap 18 has been removed. The shoulder 21 and skirt 20 are sized to fit tightly on closure 26, on bottle 12.

Upper cylinder 19 is fitted with its own removable top cap 24, which is removable upon use. Positioned below the removable top cap 24 is an upper containment disc 25 which in this embodiment is supported on a porous cylindrical filter 27. Vent ports 22 lightly hold the cylinder 27 in position until it has been inserted onto closure 26. Once the assembly has been complete, the porous cylindrical filter 27 filters aerosols which are present in the region 30 of cylindrical chamber 19 and which exit through vent ports 22 as shown by the arrows in FIG. 7.

Figure 8:
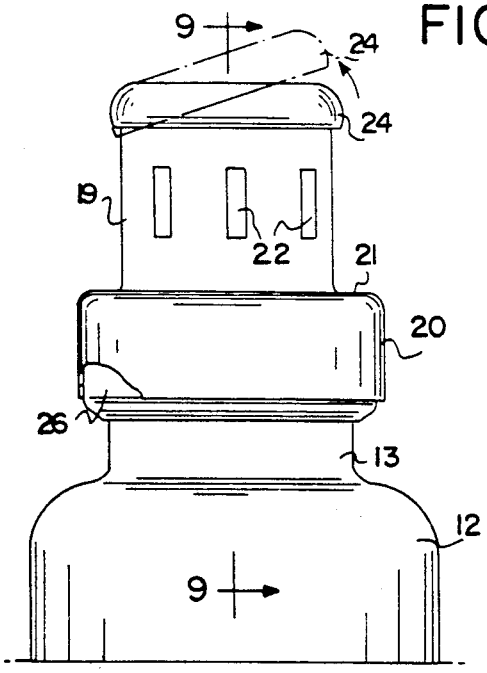
FIG. 8 is a fragmentary side elevational view of the embodiment of the present invention shown in FIG. 5, after attachment to a container.
Figure 9:
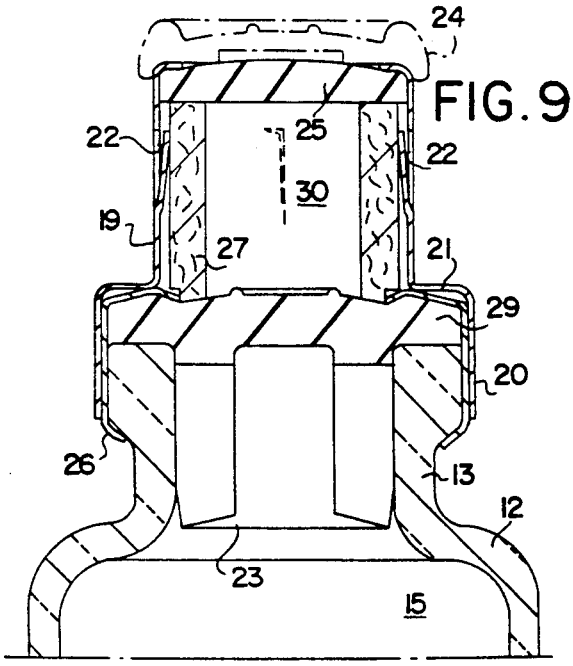
FIG. 9 is an enlarged sectional view taken along the line 9—9 in FIG. 8.
Figure 10:
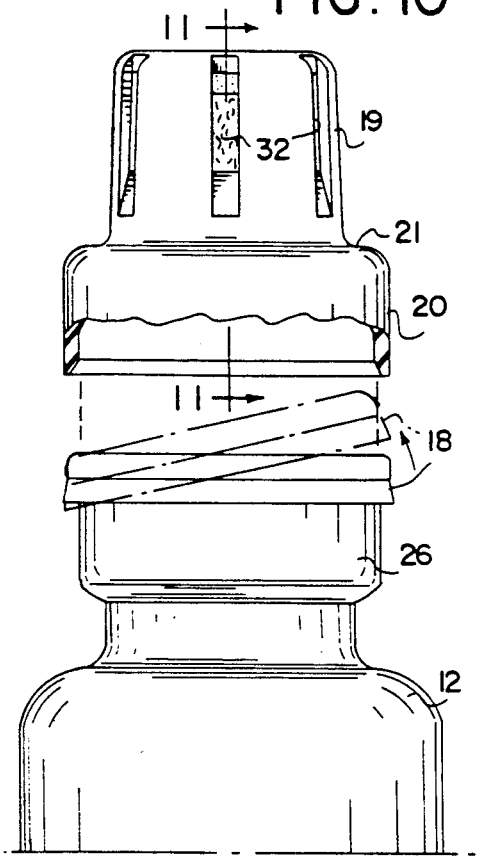
FIG. 10 is a fragmentary side elevational view showing the application of the preferred embodiment of this invention to a container.
Figure 11:
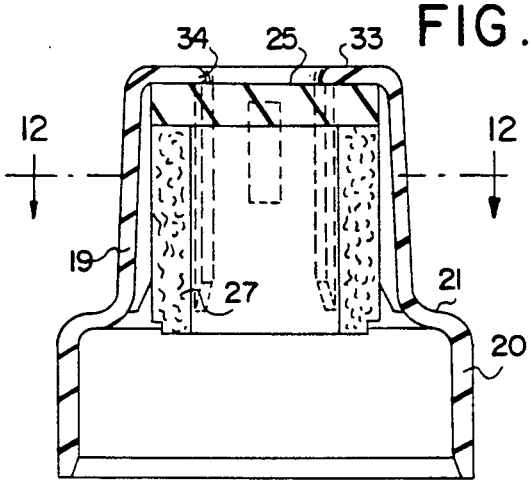
FIG. 11 is an enlarged sectional view taken along the lines 11—11 in FIG. 10.

FIGS. 8 and 9 show the device in position on a bottle 12 and ready for use. The top cap 24 is removed to expose the cylindrical disc 25, which is supported on porous cylindrical filter 27. The other end of cylindrical filter 27 rests on stopper 29 or cap 26, or both, which is centered in the bottle 12. Stopper 29 is held on the container 12 by closure 26, over which is fitted the skirt 20 and shoulder 21 of the containment assembly. Containment disc 25 and stopper 29 form the ends of chamber 30 defined by the cylindrical porous filter 27. When a needle is withdrawn from the container 12, aspiration caused by a difference in pressure between the interior 15 of the bottle 12 and atmospheric pressure is equalized in the region 30, just defined by pausing while the tip of the needle 17 is in the chamber 30. Pressure is equalized and the needle can safely be withdrawn through containment disc 25.

The preferred embodiment of the present invention is shown in FIGS. 10 through 15. In this embodiment, substantial advantages are achieved by avoiding the formation of a new primary seal as described in the previous embodiment. Specifically, primary seals are difficult to qualify with the FDA. Also concern for the integrity of a product prior to removal of any seal from the factory is primary in the eyes of the users. The embodiment shown in FIGS. 10 through 15 can be packaged in a blister pack or other sterile environment, with a pull away tab so that the cap can be attached as shown herein.

Specifically, when the preferred system is intended to be used, a conventional container 12 having a closure 26 and a top cap 18 is combined with the preferred container assembly of this invention. The top cap 18 is removed in the conventional manner. Skirt 20 is then fitted over closure 26 until shoulder 21 rests on closure 26. At this point, the porous cylindrical filter 27 rests on stopper 28 or closure 26, or both, at one end and on containment disc 25 on the other end, thereby forming chamber 30.

Figure 12:
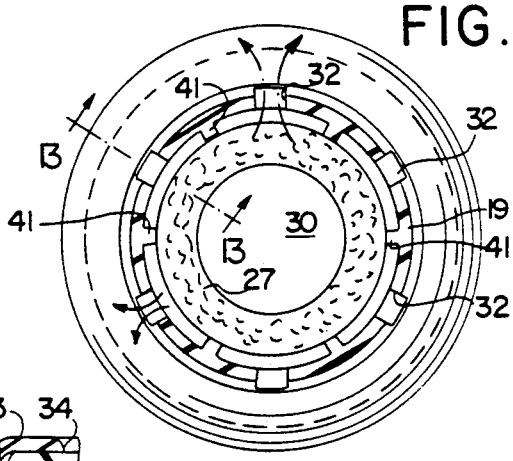
FIG. 12 is a sectional view taken along the line 12—12 in FIG. 11.
Figure 13:
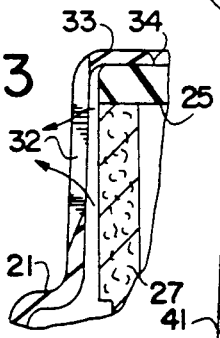
FIG. 13 is an enlarged sectional view taken along the line 13—13 in FIG. 12.
Figure 14:
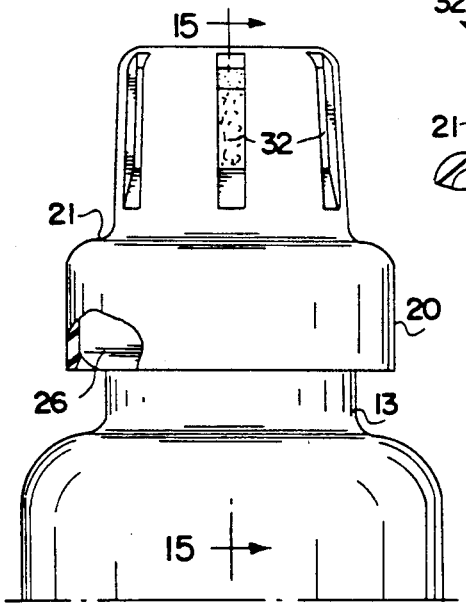
FIG. 14 is a fragmentary side elevational view of the preferred embodiment in combination with a closure.

In this particular design vent ports 32 are formed in the upper cylinder 19 to permit exhaust of gas as shown in FIG. 12. The top 33 of the upper cylinder 19 has an inner terminal edge 34 which defines a hole in top 33. The hole defined by edge 34 permits access to the containment disc 25. Containment disc 25 and stopper 28 are aligned so that a needle will penetrate both disc 25 and stopper 38 to obtain access to the interior 15 of bottle 12.

The porous filter 27 and the containment disc 25 provide additional insurance that the contents of the bottle 12 will not inadvertently contact the user. The upper cylinder 19 can be left on the bottle 12, as shown in full assembly in FIGS. 14 and 15, for as long as needed.

Figure 15:
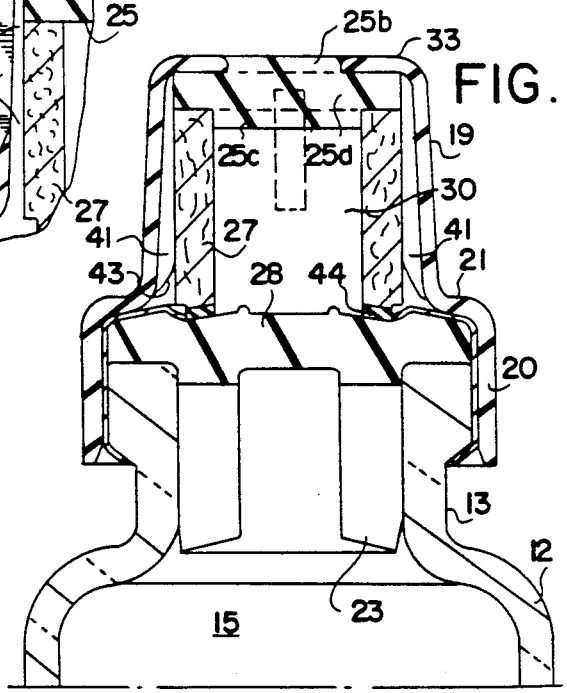
FIG. 15 is an enlarged sectional view taken along line 15—15 in FIG. 14.

The outer peripheral surface of the filter 27 may be spaced from the inner face of the cylinder 19 by ribs 41 between the filter 27 and the casing 19 to provide a flow path for the gases as they penetrate the filter 27 and vent port 32, as shown by arrows in FIG. 12. When casing 19 extend radially inward as in FIG. 14, they form vertical chambers, as seen in FIG. 15, so that the spacing permits faster venting. Ribs 41 may be tapered at the bottom 43 to facilitate insertion of the filter 27.

An alternative containment disc **25*a* is shown in FIG. 15, where the top portion 25*b* is flush with the top 33 of cap 19, so that a smooth surface is provided. Also, lower portion 25c contacts the filter 27 at its top as well as radially on the inside. An annular seal 44 may be added to further seal the chamber and promote contact between filter 27 and stopper 28**.

Figure 16:
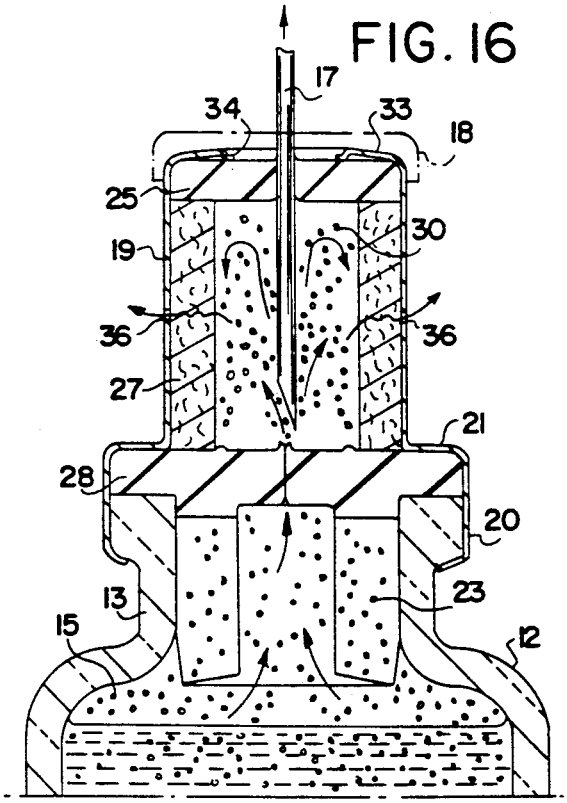

As shown in FIG. 16, a modified version of the preferred embodiment is shown with the needle 17 in the chamber 30 defined by the containment disc 25, the stopper 28 and the porous cylindrical filter 27. Holes 36 in the upper cylinder 19 are provided to allow air pressure to be equalized. The liquid which is aspirated into chamber 30 upon removal of the needle from stopper 28 is trapped by the filter and is safely kept from contaminating the operator.

Figure 18:
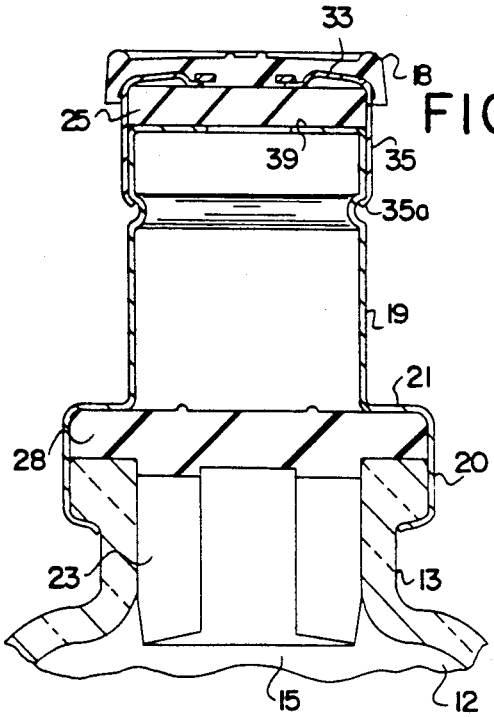
FIGS. 16, 17, 18 and 19 are enlarged sectional views of other embodiments of the present invention.
Figure 19:
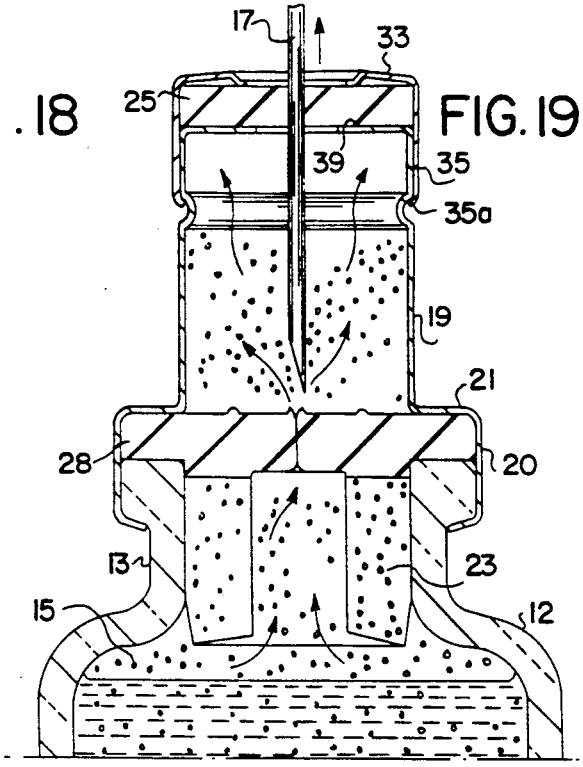
Figure 17:
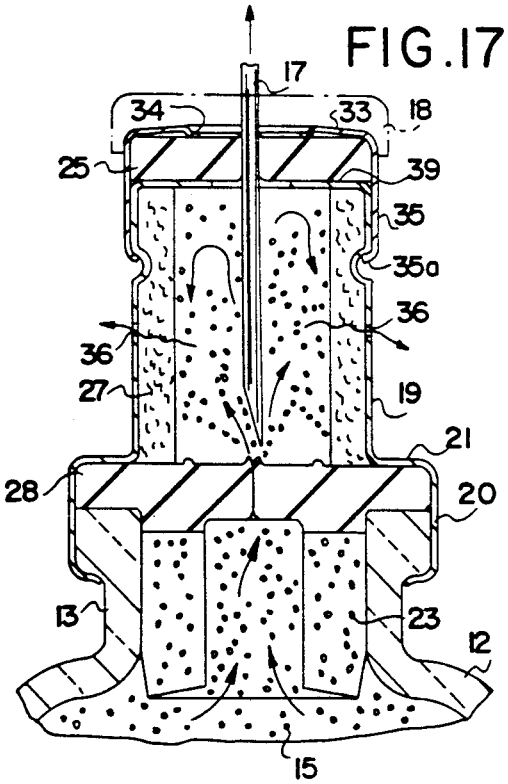

Several modified versions of the present invention are shown in FIGS. 17, 18 and 19. In FIG. 17 venting of the pressure is caused by hole 36 such as shown in FIG. 16. The disc 25 is fitted with an upper cylinder 35 so that the disc 25 rests on a secondary support shoulder 39. The upper cylinder 35 is held on lower cylinder 19 by crimp 35a. The device shown in FIGS. 18 and 19 shown similar designs without the use of a cylindrical porous filter.

While particular embodiments of the present invention have been illustrated and described herein, it is not intended to limit the invention and changes and modifications may be made therein within the scope of the following claims.

What is claimed is:

1. A cap assembly for use with a container having a stopper and a closure, comprising:

cap means including walls for defining a chamber above said stopper and including means for supporting said cap on said closure, said cap including access means penetrable by a syringe positioned in alignment with said stopper for access to said container by said syringe, and further including vent port means for communication between said chamber and the atmosphere; and filter means in said chamber for filtering gas flow through said vent port means, said filter means extending axially a substantial distance from the stopper and toward the containment disc without obstructing access to said chamber by a syringe.

2. The assembly of claim 1, wherein said filter conforms to said walls.

3. The assembly of claim 1, wherein said filter is spaced from said walls to define an annular chamber between said walls and said filter means.

4. A cap assembly with a container having stopper and a closure, comprising:

a cap means including skirt and shoulder means for fitting over a closure and for supporting said cap on said closure, and including an inside diameter and cylindrical wall means extending above said stopper to define a chamber, said wall means including at least one vent port means for communication between said chamber and the atmosphere;

containment disc means for providing access to said container by a syringe, said disc means being positioned proximate the top of said wall means and being aligned above said stopper;

filter means in said chamber for filtering gas flow through said vent port means and positioned to extend a substantial distance from said stopper and toward said containment disc in an axial direction without obstructing access to said container by a syringe.

5. The device of claim 1 wherein said cap assembly is sized to permit said shoulder and skirt to slip on to a preexisting closure of a container.

6. The device of claim 4 wherein said vent port means comprises outside columnar ribs opened for venting of air.

7. The device of claim 4, wherein said cap assembly includes standing columnar ribs on said inside of said cap for positioning and holding said filter.

8. The device of claim 1, wherein said containment disc and said caps means cooperatively provide a smooth surface at the top of said cap means.

9. The device of claim 4, wherein said containment disc contacts said filter axially at the top of said filter and radially on the inside of said filter to prevent aerosol leakage therebetween.

* * * * *